US006010575A

United States Patent [19]

Sims

[11] Patent Number: 6,010,575

[45] **Date of Patent: *Jan. 4, 2000**

[54] MULTIPLE TIP CLEANING PROCESS FOR PIPES

[75] Inventor: Peggy L. Sims, Seabrook, Tex.

[73] Assignee: Praxair Technology, Inc., Danbury, Conn.

[ * ] Notice: This patent is subject to a terminal disclaimer.

[21] Appl. No.: 08/768,602

[22] Filed: Dec. 18, 1996

Related U.S. Application Data

[63] Continuation-in-part of application No. 08/571,481, Dec. 13, 1995, Pat. No. 5,607,513.

[51] Int. Cl.[7] ..... B08B 9/04

[52] U.S. Cl. ..... 134/8; 134/22.11

[58] Field of Search ..... 134/7, 8, 22.1, 134/22.11; 15/104.061, 3.5, 3.51

[56] References Cited

U.S. PATENT DOCUMENTS

| | | | |
|---|---|---|---|
| 3,546,642 | 12/1970 | Frederick et al. | 335/305 |
| 3,573,985 | 4/1971 | Schultz | 134/8 |
| 3,704,478 | 12/1972 | Vernooy | 15/104.06 |
| 4,242,771 | 1/1981 | Knapp | 15/104.06 |
| 4,244,073 | 1/1981 | Sagawa | 15/104.06 |
| 4,693,305 | 9/1987 | Fujimoto et al. | 165/95 |
| 5,032,185 | 7/1991 | Knapp | 134/22.11 |
| 5,150,493 | 9/1992 | Sivacoe | 15/104.06 |
| 5,265,302 | 11/1993 | Sivacoe | 15/104.06 |
| 5,358,573 | 10/1994 | Sivacoe | 134/8 |
| 5,431,545 | 7/1995 | Knight et al. | 417/248 |
| 5,607,513 | 3/1997 | Sims | 134/8 |

FOREIGN PATENT DOCUMENTS

| | | |
|---|---|---|
| 0673740 | 6/1952 | United Kingdom . |
| 2229247 | 9/1990 | United Kingdom . |

*Primary Examiner*—Randy Gulakowski
*Assistant Examiner*—Saeed Chaudhry
*Attorney, Agent, or Firm*—Blake T. Biederman

[57] ABSTRACT

A process for pipe cleaning using one or more cleaning modules which are propelled through the pipe by a hydraulic fluid to apply at least two cleaning tips in a particular alternating sequence. The hydraulic fluid is inspected to determine when no further abrasive cleaning is required. When such a determination is made, another tip is applied to finish the surface of the pipe.

11 Claims, 4 Drawing Sheets

MULTIPLE TIP CLEANING PROCESS FOR PIPES

RELATED APPLICATIONS

This application is a continuation-in-part of U.S. Ser. No. 08/571,481 now U.S. Pat. No. 5,607,513, entitled "Alternating Tip Run Process for Cleaning Pipes", filed Dec. 13, 1995.

FIELD OF THE INVENTION

This invention relates to methods of cleaning pipes and more particularly to a specific sequence of using various cleaning surfaces for a cleaning module.

BACKGROUND OF THE INVENTION

Pipes used in a variety of processes often develop undesirable deposits on the inner surface of the pipe wall. These contaminants are generally known as scale. Cleaning of these pipes is done by hydraulic propulsion of a cleaning module (called a "Pig") through the pipe. One Pig has removable tips disposed circumferentially around and extending radially outward from the body of the Pig. The hydraulic pressure forces the pig through the pipe while the tips scrape the deposits from the pipe.

Some cleaning processes randomly apply different tip types, attempting to remove the adhered deposits while preventing significant erosion of the pipe wall. For example, as disclosed in U.S. Pat. No. 5,358,573, a Pig is repeatedly cycled back and forth with each tip through a section of pipe that is "dirty". While this process may eventually remove the deposits, using a module tip that is too abrasive can result in erosion and pipe scoring. Regardless of the initial state of the pipe system, any erosion or scoring could cause either process difficulties or failures.

OBJECTS OF THE INVENTION

It is therefore an object of the invention to provide an improved method for pipe cleaning that minimizes erosion and scoring while maximizing cleaning effectiveness.

It is a further object of this invention to provide such a method for pipe cleaning which utilizes a specific sequence of types of cleaning tips.

Yet another object of this invention is to provide such a method which can be practiced with a single pig using successive cleaning tips or with successive pigs, each having a different cleaning tip.

SUMMARY OF THE INVENTION

This invention comprises a method for pipe cleaning using a cleaning module (Pig) wherein cleaning tips are interchanged in a specific sequence. In one embodiment, a cleaning module is propelled by a hydraulic fluid through a section of pipe. The cleaning tip is alternated after a predetermined number of cycles with a less abrasive cleaning tip in a repeated sequence until an inspection determines that the pipe is sufficiently clean.

In a preferred embodiment, a third tip is then applied, for a set number of cycles, that is less abrasive than either of the other tips applied. The different cleaning tips are successively installed in a single Pig. Alternatively, the different tips are carried by successive Pigs.

BRIEF DESCRIPTION OF THE DRAWINGS

Other objects, features and advantages will occur to those skilled in the art from the following description of preferred embodiments and the accompanying drawings, in which.

DETAILED DESCRIPTION OF THE INVENTION

This invention may be accomplished by alternating at least two cleaning tips successively attached to a cleaning module, (sometimes referred to herein as a "Pig"), in a particular sequence of cycles.

Alternatively, successive Pigs are utilized, each Pig carrying different cleaning tips.

Figure 1A:
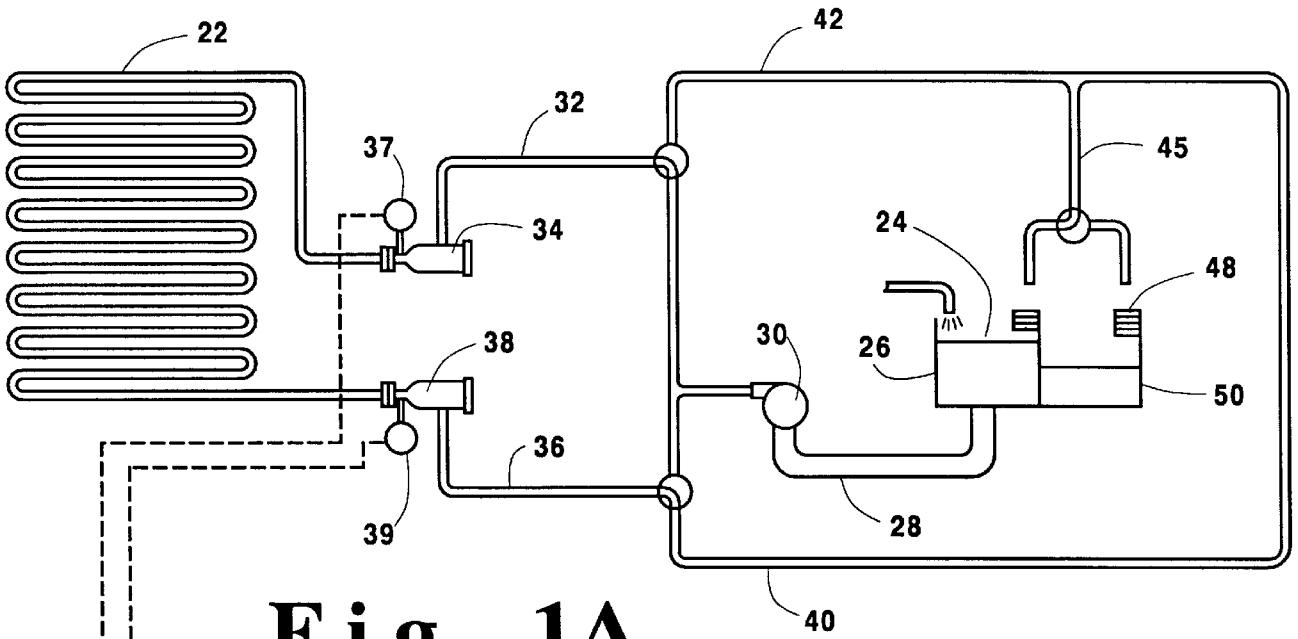
FIG. 1A is a schematic diagram of a pipe cleaning process showing the operation of the Pig of FIG. 1 with a hydraulic fluid.
Figure 1:
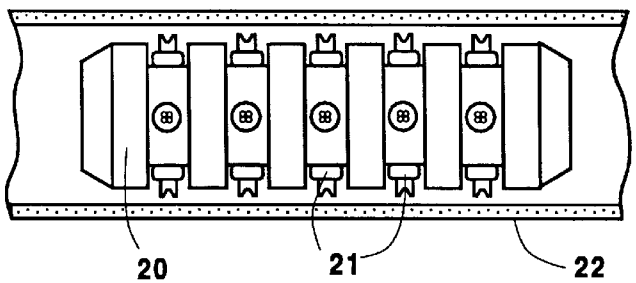
FIG. 1 is a partial cross-sectional view of a pipe containing a "Pig" carrying coverage-type tips.

Pig 20, shown in FIG. 1 with coverage-type tips 21, is propelled along the section of pipe 22 by a hydraulic fluid 24, FIG. 1A, usually water. The hydraulic fluid 24 flows from a clean tank 26 via a conduit 28 to a pump 30 which forces the hydraulic fluid 24 either through conduit 32 to Pig Launcher 34 or through conduit 36 to Pig Launcher 38. If Pig Launcher 34 is used, the Pig 20 passes through the length of pipe 22 to be cleaned and completes a cycle as it arrives at the opposite end where it can be launched again from Pig Launcher 38 for another cycle without being removed from the pipe.

The hydraulic fluid flows in the same direction of the Pig 20 and exits the piping 22 via conduit 36 through conduits 40 and 45 and catch basket 48 to the "dirty tank" 50. When the Pig 20 is propelled in the opposite direction, (i.e. launched from Pig Launcher 38), the hydraulic fluid is recovered through conduits 32, 42 and 45 to the catch basket 48. Tank 50 is emptied via stand pipe 52 to a process drain (not shown).

An inspection is made of the hydraulic fluid as it flows through catch basket 48 to determine whether further cleaning is required and what type. A different type of tip 21 is attached to the Pig 20 if required and cleaning is continued by cycling the Pig 20 through the pipe 22 again for a pre-determined number of cycles. This sequence is continued until inspection of the hydraulic fluid shows that cleaning is no longer required. The sequence may also be run with three or more types of tips 21. The location of the Pig in the pipe and of accumulation of scale is tracked by use of pressure gauges 37 and 39 attached to a chart recorder 41.

Figure 2:
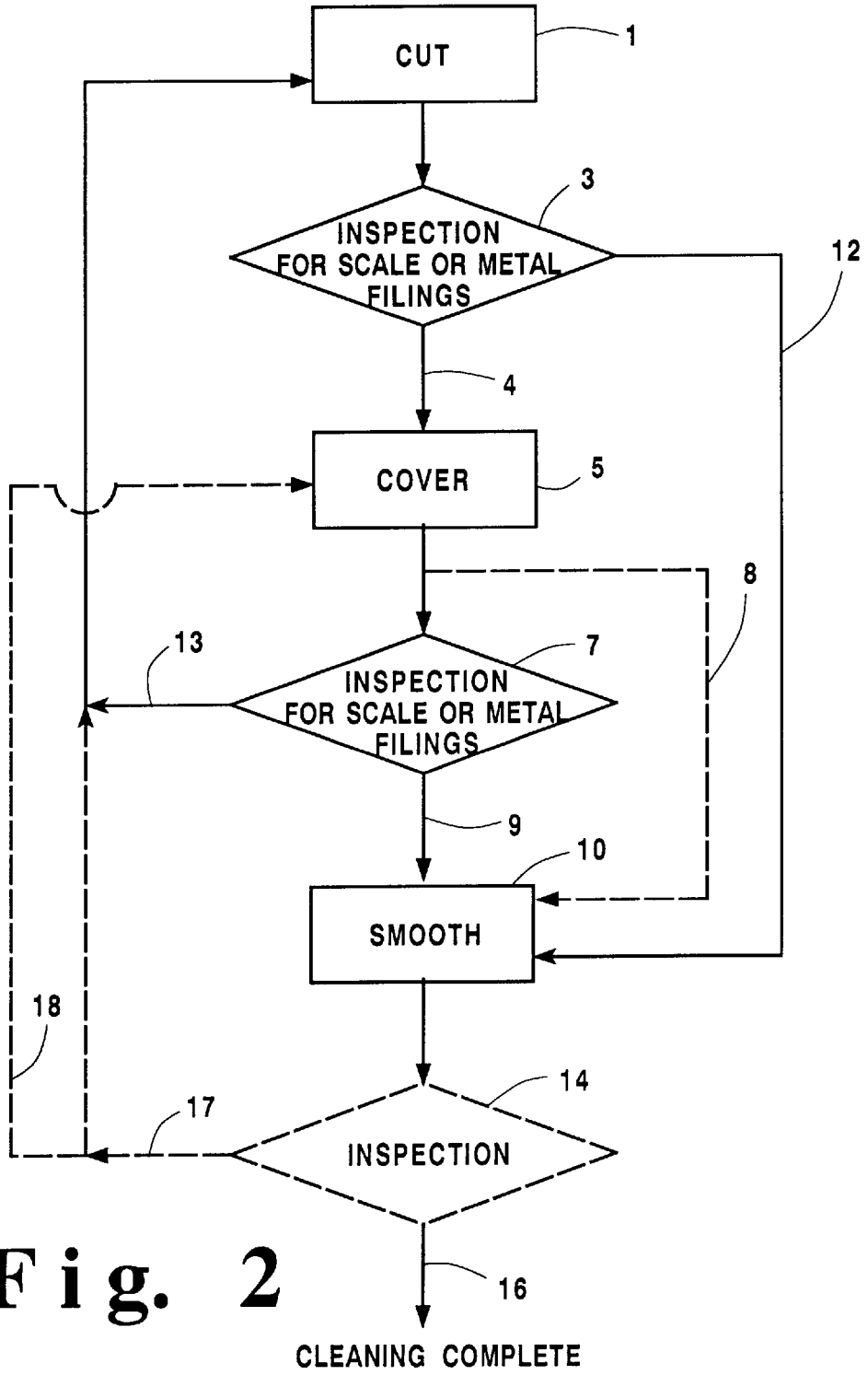
FIG. 2 is a block flow diagram of an embodiment of the invention.

The above described Alternating Tip Run (ATR) process is depicted in the block flow diagram of FIG. 2. Box 1 represents the step of propelling a Pig, with a cutting tip attached, through the pipe. The cutting tip is pointed with a sharp edge, has a narrower profile and is the most abrasive tip. Some tips used as cutting tips are Long Shank Tungsten tips or Short Tungsten tips, such as tips 750 and HW6 respectively, available from Decoking, Descaling Technology, Inc. (DDT), of Lacombe, Alberta, Canada.

After running the Pig with the cutting tip for a duration of about 2 to 25 cycles, preferably 10 to 20 cycles, (where each cycle is a complete pass through the pipe to be cleaned in one direction), an inspection is made of the hydraulic fluid to determine whether further abrasive cleaning is required. If substantial scale is present and no substantial metal filings are contained in the hydraulic fluid as it passes through a catch basket, the process follows line 4, and the cutting tip is replaced with a coverage tip in Box 5. The coverage tip, which is still used for removal of deposits or scale, also has a sharp edge but has a broader profile than the cutting tip and is less abrasive than the cutting tip. Some examples of coverage tips used are: Waffle Weave Tungsten Tip or a Split Head Tip, such as the TWB and the S/H tips also available from DDT as mentioned in the previous paragraph.

Frequent switching to the less abrasive tip after the specified number of cycles with the cutting tip prevents scoring and erosion of the surface of the pipe and also prevents creating channels in the scale covering the pipe which makes scale removal more difficult. Channeling (making deep grooves in the scale) occurs when the more abrasive tip is run for too many cycles at a time.

The Pig with a coverage tip is run for about 2 to 25 cycles, preferably 10 to 20 cycles and then, in step 7, the recovered hydraulic fluid from the pipe is inspected to determine whether further abrasive cleaning is required as may be evidenced by the presence of scale in the recovered hydraulic fluid. If further abrasive cleaning is required then the process returns along line 13 to box 1 and repeats the sequence of steps until the inspection in steps 3 or 7 shows that little or no scale is being removed.

A showing of no substantial scale or the presence of a substantial amount of metal filing in the recovered hydraulic fluid when inspected in boxes 3 or 7 requires the process to proceed along line 12 or 9 respectively, to step 10, where the pig is cycled through about 10 to 60 times, preferably about 40 times, with a smoothing tip attached. The smoothing tip does not have a sharp edge and has a broad and low profile which provides a desired finish to the surface of the pipe. Moreover, the more abrasive tip is replaced with the smoothing tip to avoid any significant scoring of the pipe. One such smoothing tip is a Tungsten Bolt Tip, called a TCB tip, which is also available from DDT.

After applying the smoothing tip, the recovered hydraulic fluid is again inspected in box 14 to determine whether cleaning is complete, 16, or whether there is still some scale present requiring the process to return to one of the more abrasive cleaning steps, i.e. along line 17 to box 1 for more abrasive, cutting, or along line 18 to box 5 for less abrasive, coverage.

In another embodiment of the cleaning process each of the three tips (cutting, followed by coverage, followed by smoothing) are each run for about 2 to 25 cycles, preferably 10 to 20 cycles. This is shown by dashed line 8 by-passing box 7 and going directly to box 10. At the end of a sequence of each of the three tips, an inspection of the exiting fluid is carried out, box 14, and the sequence as previously described is resumed following dashed line 17 to box 1. The process then continues with cutting followed by coverage tips continuously alternated every about 2 to about 25 cycles until inspection reveals that the pipe is reasonably clean and then a smoothing tip is applied for about 10 to 60 cycles, preferably about 30 to about 40 cycles to finish the surface of the pipe.

Several cutting, coverage or smoothing type tips may be used in a similar sequence and same number of cycles. New tips should be classified as either cutting, coverage, or smoothing to be used in this ATR sequence.

The ATR process described above was tested using various tip types in the sequence as shown in the following examples:

EXAMPLE 1

TABLE I

| Tip Type | TT | WW | TB | TT | WW | TT | WW | TB | TB |
|---|---|---|---|---|---|---|---|---|---|
| # Cycles | 10 | 20 | 20 | 20 | 20 | 20 | 20 | 20 | 20 |

EXAMPLE 2:

TABLE II

| Tip Type | ST | S | TB | ST | S | ST | S | TB |
|---|---|---|---|---|---|---|---|---|
| # Cycles | 20 | 20 | 20 | 20 | 20 | 20 | 20 | 20 |

In the above examples, the following tip type abbreviations and categorization apply:

| | | |
|---|---|---|
| TT | Long Shank Tungsten Tip | Cutting |
| WW | Waffle Weave Tungsten Tip | Coverage |
| TB | Tungsten Bolt Tip | Smoothing |
| ST | Short Tungsten Tip | Cutting |
| S | Split Head Tip | Coverage |

Tables I and II show the number of cycles and sequence that were used for each type of tip. Each combination shown produced good results.

Figure 3:
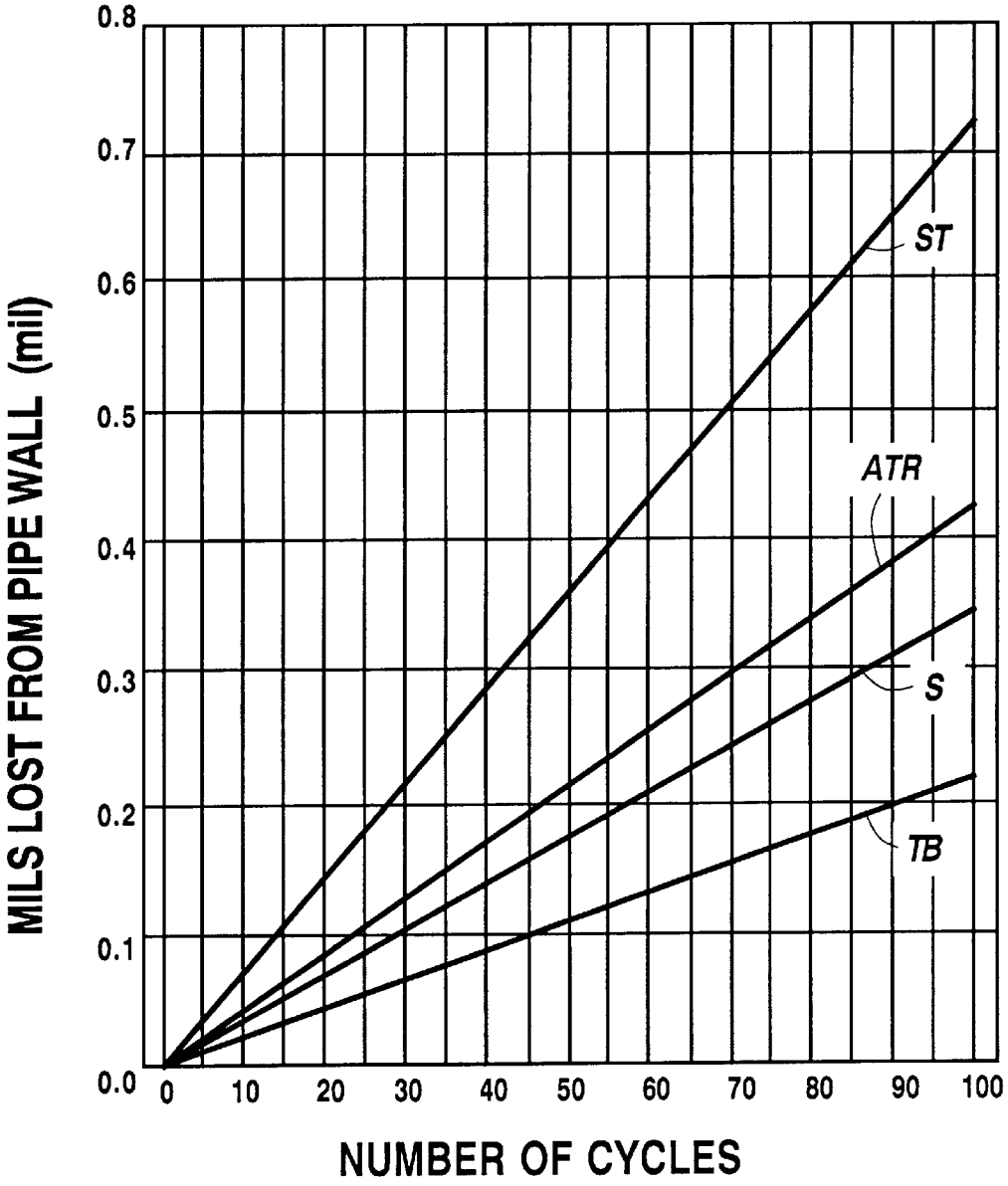
FIG. 3 is graph comparing the ATR process of the invention to alternative pipe cleaning processes.

The graph of FIG. 3 shows the results of testing on bare stainless steel pipe with the ATR process of the embodiment of the invention in example 2 as compared to testing with a single tip for the duration of the test. The tips tested were ST which was a Short Tungsten cutting tip, S which was a Split Head coverage tip and TB which was a Tungsten Bolt smoothing tip. The test revealed that the ATR process, that involved switching the three tips, (ST, S and TB) at the frequency and the sequence shown in example 2 above, results in less erosion of metal from the bare pipe wall than the cutting tip, ST, alone for an equivalent number of cycles. The Split Head coverage tip, S, and the Tungsten Bolt smoothing tip, TB, when cycled alone, achieved better results on bare pipe than the ATR process. But it is highly unlikely that either of these tips would be run alone to effectively remove scale from a pipe wall. Thus, if only one tip is used it would more likely be a cutting tip, which as shown by the graph would produce more erosion and scoring of the pipe wall.

Figure 4:
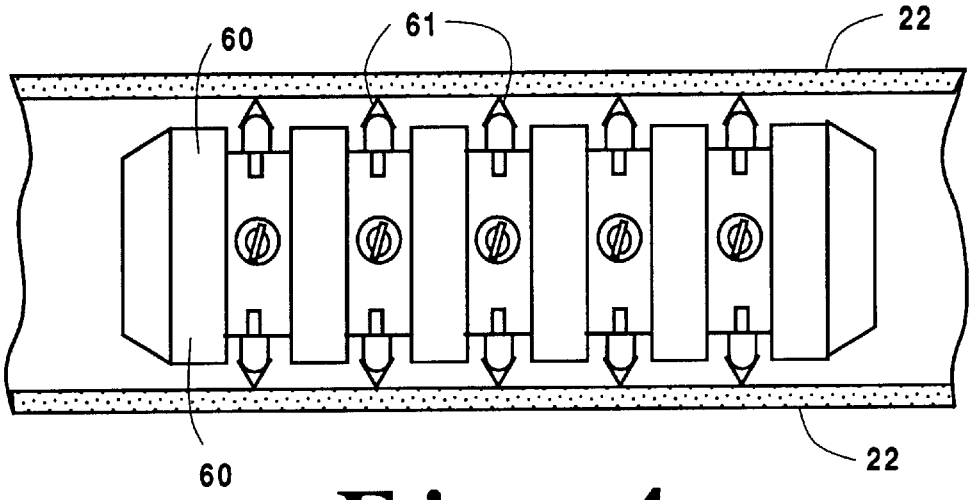
FIG. 4 is a partial cross-sectional view of a pipe containing a Pig carrying cutting-type tips.
Figure 5:
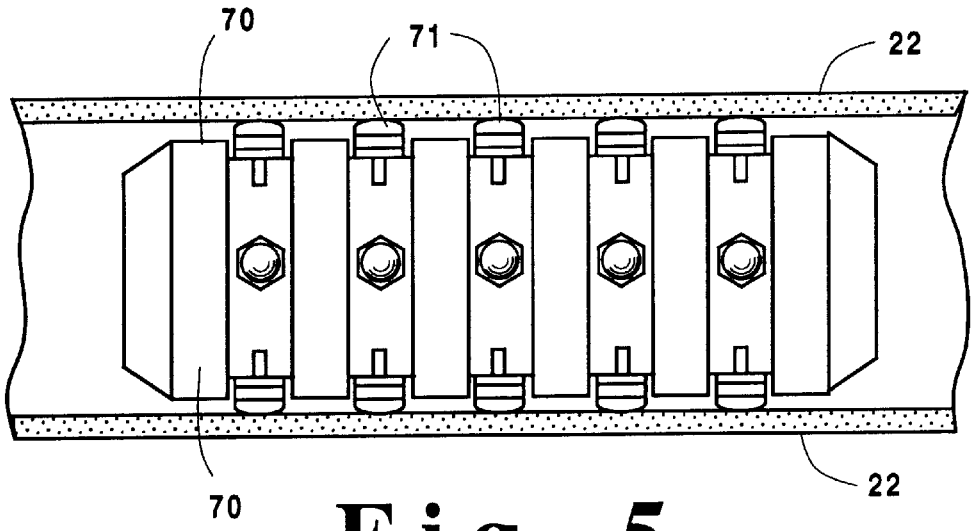
FIG. 5 is a partial cross-sectional view of a pipe containing a Pig carrying smoothing-type tips.

Instead of successively replacing cleaning tips on a single Pig, it is also within the scope of the present invention to utilize two or more Pigs, at least one of which does not have readily removable cleaning tips. For example, Pig 60, FIG. 4, carries cutting-type tips 61 that are screwed or bonded directly into the body of Pig 60 and are not replaced with successive tips. Similarly, Pig 70, FIG. 5, carries smoothing-type tips 71 that are secured into the body of Pig 70. The processes described above are conducted using the successive Pigs, each carrying different cleaning tips.

Specific features of the invention are shown in one or more of the drawings for convenience only, as each feature may be combined with other features in accordance with the invention. Alternative embodiments will be recognized by those skilled in the art and are intended to be included within the scope of the claims. For example, the process can be conducted using one cleaning module that carries one set of substantially non-removable cleaning tips and a second cleaning module that carries readily exchangable cleaning tips.

What is claimed is:

1. A process for pipe cleaning comprising:

a) providing at least two cleaning modules, each carrying a different cleaning tip, or providing at least one cleaning module to which at least two different non-removable cleaning tips are attached, the cleaning module or modules being propellable through a pipe by a hydraulic fluid;

b) successively applying at least two cleaning tips to an inner surface of the pipe using the one or more cleaning modules, the cleaning tips including a first tip and a second tip that is less abrasive than the first tip, in an alternating sequence that cycles each tip through the pipe about 2 to about 25 times before switching to the other tip;

c) periodically inspecting the hydraulic fluid as it exits the pipe to determine whether further abrasive cleaning is required and repeating step b) until no further abrasive cleaning is required; and d) applying a third tip, that is less abrasive than the first and second tips, to the surface of the pipe for about 10 to about 60 cycles after determining that no further abrasive cleaning is required.

2. The process of claim 1 wherein said first tip is a cutting tip, said second tip is a coverage tip and said third tip is a smoothing tip.

3. The process of claim 2 wherein the cutting tip is a Long Shank Tungsten Tip, the coverage tip is a Waffle Weave Tungsten Tip and the smoothing tip is a Tungsten Bolt Tip.

4. The process of claim 2 wherein the cutting tip is a Short Tungsten Tip, the coverage tip is a Split Head Tip and the smoothing tip is a Tungsten Bolt Tip.

5. The process of claim 1 wherein said first tip and said second tip are alternating in step b) in a sequence that applies each tip for about 10 to about 20 cycles before switching to the other tip.

6. The process of claim 5 wherein said third tip is applied in step d) for about 30 to about 40 cycles.

7. The process of claim 1 wherein step b) further comprises applying the third tip for about 2 to about 25 cycles after only a first application of each of the first and second tips for about 2 to about 25 cycles and wherein the third tip is not applied again until step d).

8. The process of claim 1 wherein in step c) no further abrasive cleaning is required when the hydraulic fluid entering a catch basket either contains no substantial amount of deposits or contains a substantial amount of metal filings from the pipe surface.

9. The process of claim 1 wherein at least three different cleaning modules are utilized, each module carrying one of the first, second, and third tips.

10. A process for pipe cleaning comprising:

a) providing at least two cleaning modules, each carrying a different cleaning tip, or providing at least one cleaning module to which at least two different non-removable cleaning tips are attached, the cleaning module or modules being propellable through a pipe by a hydraulic fluid;

b) successively applying at least two cleaning tips to an inner surface of the pipe using the one or more cleaning modules, the cleaning tips including a first tip and a second tip that is less abrasive than the first tip, in an alternating sequence that cycles each tip through the pipe about 2 to about 25 times before switching to the other tip;

c) periodically inspecting the hydraulic fluid as it exits the pipe to determine whether further abrasive cleaning is required;

d) applying a third tip, that is less abrasive than the first and second tips, to the surface of the pipe for about 10 to about 60 cycles; and e) conducting a further inspection after applying the third tip to determine whether there is no further substantial scale and the process is complete, or if there is still scale present, then the second tip is alternated with the third tip until no substantial scale is observed.

11. The process of claim 10 wherein at least three different cleaning modules are utilized, each module carrying one of the first, second, and third tips.

* * * * *